US006739080B2

(12) United States Patent
Derevoge et al.

(10) Patent No.: US 6,739,080 B2
(45) Date of Patent: May 25, 2004

(54) SKEIN LABEL

(75) Inventors: Philippe Thomas Derevoge, Avon (FR); Jean-Paul Ganaye, Sausheym (FR)

(73) Assignee: Dollfus & Mieg CIE-DMC, Paris (FR)

( * ) Notice: Subject to any disclaimer, the term of this patent is extended or adjusted under 35 U.S.C. 154(b) by 0 days.

(21) Appl. No.: 09/825,945

(22) Filed: Apr. 5, 2001

(65) Prior Publication Data

US 2001/0028928 A1 Oct. 11, 2001

(30) Foreign Application Priority Data

Apr. 5, 2000 (FR) ..... 00 04352

(51) Int. Cl.[7] ..... G09F 3/00
(52) U.S. Cl. ..... 40/309
(58) Field of Search ..... 40/305, 309, 316, 40/621, 665, 672

(56) References Cited

U.S. PATENT DOCUMENTS 4,139,956 A * 2/1979 Sharrow ..... 40/316

* cited by examiner

*Primary Examiner*—S. Joseph Morano
*Assistant Examiner*—Robert J. McCarry, Jr.
(74) *Attorney, Agent, or Firm*—Connolly Boye Lodge & Hutz LLP

(57) ABSTRACT

A label for a skein of yarn includes a main portion of generally quadrilateral shape for encircling the skein. A projection is integrally formed with the main portion and extends outwardly from a side of the main portion and is bent to pass through the ends of a loop of yarn formed inwardly of one end of the skein thereby keeping the loop opened. An enlarged tab is integrally formed at an outward end of the projection and is turned downward against the main portion to secure the tab in position through the ends of the loop so that the label resists slipping along the length of the skein.

2 Claims, 1 Drawing Sheet

SKEIN LABEL

FIELD OF THE INVENTION

The present invention relates to a label intended for an assembly of yarns folded over themselves in several turns (hereafter, called a "skein") and allowing the said yarns to be neatly separated by creating a loop made in the skein (small hank).

BACKGROUND OF THE INVENTION

According to another aspect of the invention, it relates to a device for supporting the skein provided with this label, saving time and allowing the user to handle it more easily.

Wool yarns, silk yarns, cotton yarns, etc. are generally presented either in the form of a skein held in position by means of two labels going around the latter in its upper and lower parts, or in the form of reels or balls. Presentation in the form of skeins allows the product to be easily handled and transported.

When using this product, the consumer is required either to remove the labels from the skein before winding it up on a support of the type comprising a piece of cardboard or the like, before being able to start to work, or to pull the necessary yarn while ensuring that the coils as they are do not drop. It will be easily understood that the latter step is irksome.

Moreover, after the labels have been removed from the skein, the yarns which are no longer held in place by the latter tend to entangle, which does not facilitate the user's task.

Finally, once the yarn has been wound onto its work support, it is necessary to copy down the color number of the yarn, which number is generally written on one of the labels for holding the skein in place, without which, when the shades of color are highly varied, the user can no longer identify the colors that he has to use.

BRIEF DESCRIPTION OF THE INVENTION

The present invention therefore aims to alleviate such drawbacks by providing a label with a tab for holding the skein in place, which allows neat separation of the yarns by creating in a definitive manner a loop made in the skein.

For this purpose, the label intended to go around a skein of yarns or the like according to the invention is characterized in that it comprises a projecting part extended by a tab which can be folded down inside a loop of the said skein so as to neatly separate the said yarns by creating the said loop in a permanent way, and to limit any relative slip of the label with respect to the said skein.

BRIEF DESCRIPTION OF THE FIGURES

Further features and advantages of the present invention will become apparent from the description given below, with reference to the appended drawings which illustrate one embodiment thereof which is devoid of any limiting character. In the figures.

DETAILED DESCRIPTION OF THE INVENTION

Figure 1:
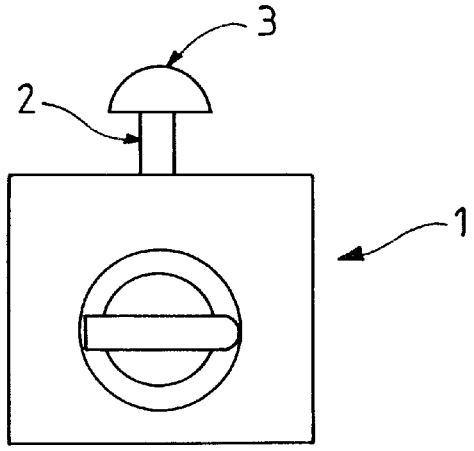
FIG. 1 shows a plan view of the label according to the invention.

FIG. 1 shows the label 1 according to the invention that preferably has a main sleeve portion of square or rectangular shape of closed continuous cross section, and has a projecting part 2 extended by a tab 3 in the form of, for example, a mushroom (or half-moon). This label is intended to go around an assembly 4 of yarns folded on themselves in several turns ("skein" or small hank) and is held in this position by any adhesive bonding means. Of course, two labels 1 and 1' may be used in order to hold the said skein in place, it being possible for one or both of them to be labels according to the invention.

Figure 2:
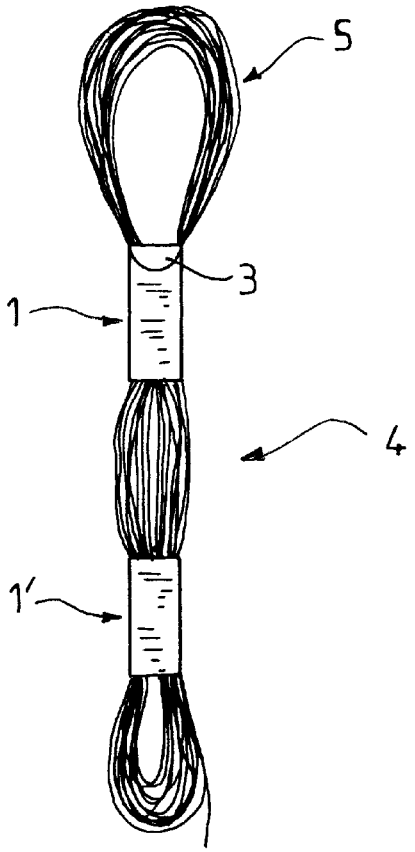
FIG. 2 is a plan view of a skein combined with the label according to the invention.

Once the label has been mounted on the skein 4 (cf. FIG. 2), the tab 3 extending the projecting part 2 of the latter is folded down inside one of the loops 5 formed at the two ends of the said skein so as to neatly separate, in a permanent way, the yarns within this loop. The said tab separates the two sides of the said loop formed by the yarns above the label and therefore makes it easier for the skein to be used.

Furthermore, the presence of the tab 3 prevents any unintentional relative slip of the label 1 with respect to the skein 4, which would consequently disorganize the assembly of yarns in the skein and possibly result in the loss of the latter.

What is claimed is:

1. A label for a skein of yarn, comprising:

a main sleeve portion of closed continuous cross section for encircling the skein;

a projection integrally formed with the main portion and extending outwardly from a side of the main portion and bent to pass through an end of a loop of yarn formed at one end of the skein to keep the loop opened; and an enlarged tab integrally formed at an outward end of the projection and turned downwardly against the main portion to secure the tab in position through the end of the loop whereby the label resists slipping along the length of the skein.

2. A label as set forth in claim 1, further comprising at least one additional label positioned inwardly of a second end of the skein.

* * * * *